US009644280B2

(12) United States Patent
Bussetti

(10) Patent No.: US 9,644,280 B2
(45) Date of Patent: May 9, 2017

(54) PROCESS FOR ELECTROLYTICALLY DEPOSITING A TIN- AND RUTHENIUM-BASED ALLOY, THE ELECTROLYTIC BATH THEREFORE AND THE ALLOY OBTAINED THEREWITH

(71) Applicant: VALMET S.P.A., Calenzano (FI) (IT)

(72) Inventor: Samuele Bussetti, Prato (IT)

(73) Assignee: VALMET PLATING S.R.L., Calezano (FI) (IT)

( * ) Notice: Subject to any disclaimer, the term of this patent is extended or adjusted under 35 U.S.C. 154(b) by 0 days.

(21) Appl. No.: 14/759,293

(22) PCT Filed: Nov. 18, 2013

(86) PCT No.: PCT/IB2013/060214
§ 371 (c)(1),
(2) Date: Jul. 6, 2015

(87) PCT Pub. No.: WO2014/111761
PCT Pub. Date: Jul. 24, 2014

(65) Prior Publication Data

US 2015/0354076 A1 Dec. 10, 2015

(30) Foreign Application Priority Data

Jan. 18, 2013 (EP) ..... 13425013

(51) Int. Cl.
*C25D 3/60* (2006.01)
*C25D 3/56* (2006.01)

(52) U.S. Cl.
CPC *C25D 3/60* (2013.01); *C25D 3/56* (2013.01)

(58) Field of Classification Search
CPC ..... C25D 3/56; C25D 3/60
USPC ..... 205/253, 257, 259
See application file for complete search history.

(56) References Cited

U.S. PATENT DOCUMENTS

| | | | | |
|---|---|---|---|---|
| 3,933,602 A * | 1/1976 | Henzi | C25D 3/567 205/257 |
| 4,686,017 A * | 8/1987 | Young | A01N 59/02 205/234 |
| 4,749,626 A | 6/1988 | Kadija | |
| 6,361,823 B1 | 3/2002 | Bokisa | |
| 2005/0173255 A1* | 8/2005 | Bokisa | C25D 3/562 205/255 |

OTHER PUBLICATIONS

Dos Santos S M et al: "Performance of RuSn catalysts supported on different oxides in the selective hydrogenation of dimethyl adipate," CATALYSIS TODAY, Elsevier, NL, vol. 107-108, Oct. 30, 2005, pp. 250-257 p. 251, right-hand column, para. 2; Experimental.

Springerova Jana et al: "Selective hydrogenation of .alpha., .beta.-unsaturated carbonyl compounds on supported Ru—Sn catalysts," Research of Chemical Intermediates, Amsterdam, NL, vol. 31, No. 9, Jan. 1, 2005, pp. 785-795 Abstract; pp. 786-787, paragraph materials and methods; p. 790; Table 1.

* cited by examiner

*Primary Examiner* — Edna Wong
(74) *Attorney, Agent, or Firm* — Themis Law

(57) ABSTRACT

The invention refers to the electrolytic deposit of a tin- and ruthenium-based alloy having good features of corrosion resistance. In particular, the invention refers to an ecologically compatible process to achieve the electrolytic deposit of the alloy and to the operative conditions to make the deposit. Moreover, the invention refers to the electrolytic bath from which the alloy is caused to electro-deposit. In particular, the electrolytic bath is advantageously distinguished by the total absence of toxic metals and cyanides. The invention refers also to the alloy obtained through that process, as well as to the object/manufactured article covered with the alloy obtained through that process.

16 Claims, No Drawings

PROCESS FOR ELECTROLYTICALLY DEPOSITING A TIN- AND RUTHENIUM-BASED ALLOY, THE ELECTROLYTIC BATH THEREFORE AND THE ALLOY OBTAINED THEREWITH

TECHNICAL FIELD

The invention refers to the electrolytic deposition of a substantially tin- and ruthenium-based alloy having optimal features of corrosion resistance. In particular, the invention refers to an ecologically compatible process to realize the electrolytic deposit of said alloy and to the operative conditions to realize said deposit.

Moreover, the invention refers to the electrolytic bath by which said alloy is made to electro-deposit. In particular, said electrolytic bath is advantageously distinguished by the total absence of toxic metals and cyanides.

The invention also refers to said alloy obtained through said process, as well as to the object/manufactured article covered with said alloy obtained through said process.

BACKGROUND ART

In the field of electro-deposition, for example in the decorative one, some types of tin-based alloys are known. Among the most commonly used there are those comprising also other metals such as, for example nickel, lead, copper, zinc, etc. This implies that, together with tin, also allergenic or toxic metals are currently co-deposited. Moreover, in order to obtain this result, alkali electrolytic baths that contain cyanides are normally used. All this reflects negatively both from the point of view of toxicity of the baths and of their final products, and from the point of view of toxicity and/or of the eco-compatibility of the entire production process.

Moreover, a great part of the tin-based alloys known in the field, which are deposited with a level of tin superior to the 50%, have, for example, a scarce resistance to fumes of nitric acid (as well as to acids in general), oxidizing and/or corroding too quickly.

To sum up what has been explained above, unfortunately said alloys are not sufficiently resistant and contain, as additional components, or also just as traces, metals and/or residues of elaboration that are toxic for man and the environment.

TECHNICAL PROBLEM

It remains desirable, among the operators of the field, the need to have at disposal a tin-based alloy which does not present the above cited inconveniences and that results also advantageous in terms of duration and of aesthetic aspect. Moreover, it is equally desirable that such an alloy can also be used as a re-enforcing under layer before the application of a final decorative finishing (said finishing is usually constituted by a thin layer of a precious metal), thus conferring further advantageous physical-chemical performances to the finite object.

It is the subject of the present invention to overcome all or at least a great part of these inconveniences, thus giving an adequate response to the above described technical problem.

DISCLOSURE OF INVENTION

The applicant has now totally unexpectedly found out that, by electrolytically depositing an appropriate substantially tin- and ruthenium-based alloy by an appropriate electrolytic bath (electrolyte) not containing toxic products and/or metals, it is possible to give an adequate response to the technical problem described before.

It is therefore the subject of the present invention a process to achieve the electrolytic (galvanic) deposition of a substantially tin- and ruthenium-based alloy on a cathode soaked into an appropriate electrolytic bath (electrolytic solution) containing at least an effective amount of tin, and/or of one of its salts, and at least an effective quantity of ruthenium, and/or of one of its salts.

It is another subject of the present invention is to provide the above mentioned electrolytic bath.

Another subject of the invention is also the substantially tin- and ruthenium-based alloy obtained through the above process.

It is another subject of the present invention is to provide an object/manufactured article realized through the electrolytic deposition method of the above described bath.

Further subjects of the present invention are also described hereinafter.

DETAILED DESCRIPTION OF THE INVENTION

Definitions:

from now onwards, for greater simplicity, by the term "tin" it is intended indifferently metal tin (Sn) and/or one or more salts thereof;

from now onwards, for greater simplicity, by the term "ruthenium" it is intended indifferently metal ruthenium (Ru) and/or one or more salts thereof.

The present invention is directed to a process for electrolytically depositing a layer of a substantially tin- and ruthenium-based alloy on a cathode soaked into an aqueous electrolytic bath containing at least effective amounts of tin, ruthenium, conductor salts, complex-forming salts, alkali metal hydroxides, in which said process is characterized in that in said aqueous electrolytic bath:

tin (under the form of metal or one or more of its salts) is present in an amount comprised between 1 and 100 g/L per liter of electrolytic bath; preferably, between 5 and 50 g/L; still more preferably, of about 15 g/L;

ruthenium (under the form of metal or one or more of its salts) is present in an amount comprised between 0.030 and 10 g/L per liter of electrolytic bath; preferably, between 0.1 and 5 g/L; still more preferably, of about 0.8 g/L;

the conductor salts, taken alone or in a mixture thereof, are present in an overall amount comprised between 5 and 100 gr/L per liter of electrolytic bath; preferably, between 10 and 50 gr/L; still more preferably, of about 30 gr/L;

the complex forming salts are present in an overall amount comprised between 10 and 100 g/L per liter of electrolytic bath; preferably, between 20 and 50 gr/L; still more preferably, between 30 and 40 gr/L;

the alkali metal hydroxides are present in an amount comprised between 0.2 and 10 gr/lt per liter of electrolytic bath; preferably, between 1 and 3.5 g/L; still more preferably, of about 3 g/L;

with the proviso that, in said electrolytic bath cyanides and toxic and allergenic metals or metalloids, such as Be, Ni, Cd, As, Tl, are absent.

In the method of the present invention:

the tin salts according to the invention are preferably selected from tin (II) salts and tin (IV) salts;

examples of tin salts (II) comprise: sulphate, chloride, bromide, iodide, oxide, phosphate, pyrophosphate, acetate, citrate, gluconate, tartrate, lactate, succinate, sulphamate, phormiate;

examples of tin (IV) salts comprise: sodium stannate, potassium stannate, nitrate, chloride and sulfide;

ruthenium salts according to the invention are preferably selected from ruthenium (III) salts and ruthenium (IV) salts;

examples of ruthenium salts comprise the groups: sulfide, carboxylate, chlorides, bromides, oxalate, sulphamate, composed nitrile, oxydryl;

the conductor salts are preferably selected from the group consisting of: phosphates, carbonates, citrates, sulphates, tartrates, oxalates, sulphamates, gluconates, phosphonates, acetates and pyrophosphates;

the complex forming salts are preferably selected from the group consisting of: sulphates, carboxylates, chlorides, oxalates, pyrophosphates, citrates, sulphamates, gluconates, tartrates, phosphates, phosphonates;

the hydroxides of the alkali metals are selected from sodium hydroxide and potassium hydroxide.

In the method of the present invention, the cathode is constituted, on the basis of the realization needs and of the applicative field, by an appropriate metal object/manufactured article, for example made of brass, zamak, iron or aluminium, preferably, previously covered with deposits of electrolytic copper, nickel, bronze, gold, palladium and the alloys thereof, and the like.

In the method of the present invention, the anode or the anodes is/are generally made of titanium coated with platinum, ruthenium, iridium or alloys from these metals.

The process of electro-deposition of the present invention is made at pH values comprised between 10 and 14; preferably, between 11 and 13; still more preferably, of about 12.

The process of electro-deposition of the present invention is made at a temperature comprised between 30° C. and 75° C.; preferably, between 35° C. and 70° C. In a preferred embodiment of the invention, the temperature is comprised between 40° C. and 60° C.

Moreover, the process of electro-deposit of the present invention is made at a density/intensity of current comprised between 0.5 and 5 Amp/dm$^2$; preferably, between 1 and 4 Amp/dm$^2$.

Moreover, during the realization of the method of the present invention, it is necessary to maintain constant a cathodic agitation and of the electrolyte.

The duration of the process of electro-deposition of the present invention is variable on the basis of the size of the object (the cathode) that wants to be coated with the tin-ruthenium alloy of the invention; of the intensity/density of the current employed; and of the thickness of the layer of alloy that is to be deposited. In any case, the time of electro-deposition is on average variable between 1 and 10 min; preferably, between 2 and 6 min.

The electrolytic bath of the present invention can further comprise one or more additional components selected from the group consisting of wetting agents, depolarizing agents, rinse-aid/brightness giving agents, other metal traces, organometallic compounds, stabilizing agents.

For example, in a preferred embodiment of the invention, the bath can comprise one or more among the following additional additives, possibly an appropriate mixture of them.

(i) Between 1 and 20 mL/L of at least a wetting agent; preferably between 2 and 10 mL/L; still more preferably, of about 5 mL/L.

Said at least one wetting agent is selected from all those known that are compatible with alkali environments.

Preferably, the wetting agent is selected from non-ionic surfactants. For example, it is selected from the group consisting of: polyoxyethylene β-naphthol ether, polyoxyethylene alkyl ether, polyoxyethylene phenylether, polyoxyethylene alkylamino ether, polyethylene glycol.

The wetting agent can also be selected from one or more cationic surfactants, anionic surfactants or amphoteric surfactants.

Examples of cationic surfactants comprise: dodecyltrimethyl ammonium salt, hexadecyltrimethyl ammonium salt, octadecyltrimethyl ammonium salt, dodecyldimethyl ammonium salt, cetyltrimethyl ammonium salt, dodecyldimethyl ammonium betaine, octadecyldimethyl ammonium betaine, dimethylbenzyldodecyl ammonium salt, trimethylbenzyl ammonium salt, octacecylamino acetate and dodecilamino acetate.

Examples of anionic surfactants comprise: alkyl sulphates, sodium dodecyl sulphate, lauryl sulphate, lauryl sulphonate, dodecyl sulphate, octadecyl sulphate, polyoxyethylene alkylether sulphates, sodium polyoxyethylene (E012) nonyl ether sulphate, polyoxyethylene alkylphenylether sulphates, alkylbenzenesulphonates.

Examples of amphoteric surfactants comprise betaine and sulphobetaine.

(ii) Between 0.1 and 20 g/L of a depolarizing agent; preferably, da 1 a 10 g/L; still more preferably, of about 5 g/L.

Preferably, said depolarizing agents are selected from the group consisting of: salts of alkali tartrates and alkali sulphites.

(iii) Between 0.010 and 5 mL/L of at least a rinse-aid/brightness giving agent; preferably between 0.050 and 3 mL/L; still more preferably, of about 0,100 mL/L.

Preferably, said rinse-aid/brightness giving agents are selected from the group consisting of: butyndiol derivatives, di-thiocarboxylic acids, rhodium salts, silver salts and saccharinates.

(iv) Modest amounts or traces, in any case not superior to 5% in weight, with respect to the overall amount of the salts constituting the bath; preferably, not superior to 3%; of the following metals: Zn, Rh, Pd, Au, Ga, Bi, Ag, Ta, In, Fe.

The examples that follow have the only purpose of illustrating the invention in detail, in particular, the composition of the electrolytic bath from which it is possible to obtain/deposit the alloy that is the subject of the present invention and are absolutely not limiting of the wide applicative potential of the same.

EXAMPLE 1

Composition of an aqueous electrolytic bath according to the invention and its application:

| | |
|---|---|
| Sn | 15 g/L |
| Ru | 0.8 g/L |
| KOH | 4 g/L |
| Wetting agent | 0.01 g/L |
| Potassium oxalate | 5 g/L |
| Potassium citrate | 30 g/L |

In the present example, the wetting agent can be indifferently any one of those described above, preferably the cetyltrimethylammonium chloride or the sodium dodecyl sulfate.

In the present example the pH of the bath is =12; the operating temperature is =50° C. and the density of current employed is =2 Amp·dm$^2$.

EXAMPLE 2

Composition of an aqueous electrolytic bath according to the invention and its application:

| | |
|---|---|
| Sn | 25 g/L |
| Ru | 0.9 g/L |
| KOH | 4 g/L |
| Wetting agent | 0.01 g/L |
| Potassium oxalate | 2 g/L |
| Sodium and potassium tartrate | 50 g/L |

In the present example, the wetting agent can be indifferently any one of those described before, preferably the cetyltrimethylammonium chloride or the sodium dodecyl sulfate.

In the present example the pH of the bath is =12; the operating temperature is =45° C. and the density of current employed is =1 Amp·dm$^2$.

Moreover, in the present example the electrolytic bath is contained in a polypropylene bath (PVC) and can be thermoregulated by means of a heater in quartz, PTFE, porcelain or steel.

The present invention is not limited by the examples illustrated; many variants and alternatives are in fact possible that will result easily realizable by the experts in the field in the light of the teaching of the present description and of the attached claims.

Some of the advantageous features of the present invention are represented, among others, by the following aspects:

the electro-deposited alloy is provided with an optimal resistance to oxidation and to acid agents;

the electro-deposited alloy is exempt from toxic and allergenic metals or metalloids;

the electrolyte of the bath is totally exempt from cyanides and from other toxic and polluting substances;

the performance of the deposit process is at least equal, when not superior, to those of traditional processes;

the layer deposited is provided with a good brightness and resistance to oxidation;

great homogeneity of the distribution of the alloy to the different densities of current has been found also on cathodes of complex shapes and not linear;

the colour of the alloy is comprised between white and grey.

The advantages obtained with the method of the present invention derive in particular also from the type of electrolytic bath employed.

As a consequence, also said bath, as described in the preceding description, is one of the subjects of the present invention.

Substantially tin- and ruthenium-based alloys, deposited electrolytically on an object (cathode) in accordance with the method of the present invention, are not known until now to the best of knowledge of the applicant.

As a consequence, also said Sn—Ru alloy, as described in the preceding description, is one of the subjects of the present invention.

In the light of all the above, it is a further subject of the present invention also a manufactured product/an article coated with said Sn—Ru alloy realized through the method of electrolytic deposit from the electrolytic bath of the present invention.

It is also a further subject of the present invention a substantially tin- and ruthenium-based alloy obtained with the process as described herein.

It is also a further subject of the present invention an article/manufactured article coated with a substantially tin- and ruthenium-based alloy obtained as described above.

The invention claimed is:

1. A process for electrolytically depositing a layer of a tin- and ruthenium-based alloy on a cathode soaked into an aqueous electrolytic bath, comprising:

providing, in said aqueous electrolytic bath, at least:

tin in an amount comprised between 1 and 100 g/L of electrolytic bath;

ruthenium in an amount comprised between 0.030 and 10 g/L of electrolytic bath;

one or more conductor salts in an amount comprised between 5 and 100 g/L of electrolytic bath;

complex forming salts in an amount comprised between 10 and 100 g/L of electrolytic bath; and alkali metal hydroxides in an amount comprised between 0.2 and 10 g/L of electrolytic bath;

wherein, in said electrolytic bath, cyanides, toxic and allergenic metals or metalloids, and Be, Ni, Cd, As, and Tl are absent; and electrolytically depositing the layer of the tin- and ruthenium based alloy on the cathode soaked in the aqueous electrolytic bath.

2. The process according to claim 1, wherein:

tin is selected from the group consisting of metallic tin, tin (II) salts, and tin (IV) salts;

ruthenium is selected from the group consisting of metallic ruthenium, ruthenium (III) salts, and ruthenium (IV) salts;

the conductor salts are selected from the group consisting of phosphates, carbonates, citrates, sulphates, tartrates, oxalates, sulphamates, gluconates, phosphonates, acetates, and pyrophosphates; and the alkali metal hydroxides are selected from the group consisting of sodium hydroxide and potassium hydroxide.

3. The process according to claim 1, wherein:

the cathode is made of metal, brass, zamak, plastic, ABS (Acrylonitrile Butadiene Styrene), iron or aluminum; and one or more anodes are made of titanium coated with platinum, ruthenium, graphite, iridium, or alloys thereof.

4. The process according to claim 1, wherein: pH is comprised between 10 and 14;

temperature is comprised between 30° C. and 75° C.; and current intensity is comprised between 0.5 and 5 Amp/dm$^2$.

5. The process according to claim 1, wherein said electrolytic bath further comprises one or more additional components selected from the group consisting of wetting agents, depolarizing agents, rinse-aid/brightness giving agents, other metals in traces, organometallic compounds, stabilizing agents, and mixture thereof.

6. The process according to claim 5, wherein said wetting agents are present in a total amount comprised between 1 and 20 mL/L and are selected from the group consisting of:

non-ionic surfactants including one or more of polyoxyethylene β-naphthol ether, polyoxyethylene alkyl ether, polyoxyethylene phenylether, polyoxyethylene alkylamino ether, or polyethylene glycol;

cationic surfactants including one or more of dodecyltrimethyl ammonium salt, hexadecyltrimethyl ammonium salt, octadecyltrimethyl ammonium salt, dodecyldimethyl ammonium salt, cetyltrimethyl ammonium salt, dodecyldimethyl ammonium betaine, octadecyldimethyl ammonium betaine, dimethylbenzyldodecyl ammonium salt, trimethylbenzyl ammonium salt, octacecylamino acetate, or dodecilamino acetate;

anionic surfactants including one or more of alkyl sulphates, sodium dodecyl sulphate, lauryl sulphate, lauryl sulphonate, dodecyl sulphate, octadecyl sulphate, polyoxyethylene alkylether sulphates, sodium polyoxyethylene (EO12) nonyl ether sulphate, polyoxyethylene alkylphenylether sulphates, or alkylbenzenesulphonates; and amphoteric surfactants including one or more of betaine or sulphobetaine.

7. The process according to claim 5, wherein said depolarizing agents are present in a total amount comprised between 0.1 and 20 g/L, and are selected from the group consisting of: salts of alkali tartrates and alkali sulphites.

8. The process according to claim 5, wherein said rinse-aid/brightness giving agents are present in a total amount comprised between 0.010 and 5 mL/L, and are selected from the group consisting of: butyndiol derivatives, di-thiocarboxylic acids, rhodium salts, silver salts, and saccharinates.

9. The process according to claim 5, wherein said other metals are present in an amount not higher than 5%, with reference to a total amount of salts in the electrolytic bath, and are selected from the group consisting of: Zn, Rh, Pd, Au, Ga, Bi, Ag, Ta, In, and Fe.

10. An electrolytic bath for depositing a layer of a tin- and ruthenium-based alloy on a cathode, comprising:

tin in an amount comprised between 1 and 100 g/L of electrolytic bath;

ruthenium in an amount comprised between 0.030 and 10 g/L of electrolytic bath;

one or more conductor salts in an amount comprised between 5 and 100 g/L of electrolytic bath;

complex forming salts in an amount comprised between 10 and 100 g/L of electrolytic bath; and alkali metal hydroxides in an amount comprised between 0.2 and 10 g/L of electrolytic bath;

wherein, in said electrolytic bath, cyanides, and toxic and allergenic metals or metalloids, and Be, Ni, Cd, As, and Tl are absent.

11. The electrolytic bath according to claim 10, wherein:

tin is selected from the group consisting of metallic tin, tin (II) salts, and tin (IV) salts;

ruthenium is selected from the group consisting of metallic ruthenium, ruthenium (III) salts, and ruthenium (IV) salts;

the conductor salts are selected from the group consisting of phosphates, carbonates, citrates, sulphates, tartrates, oxalates, sulphamates, gluconates, phosphonates, acetates, and pyrophosphates; and the alkali metal hydroxides are selected from the group consisting of sodium hydroxide and potassium hydroxide.

12. The electrolytic bath according to claim 10, wherein:

pH is comprised between 10 and 14;

temperature is comprised between 30° C. and 75° C.; and current intensity is comprised between 0.5 and 5 Amp/$dm^2$, further comprising one or more additional components selected from the group consisting of wetting agents, depolarizing agents, rinse-aid/brightness giving agents, other metals in traces, organometallic compounds, stabilizing agents, and mixture thereof.

13. The electrolytic bath according to claim 12, wherein said wetting agents are present in a total amount comprised between 1 and 20 mL/L and are selected from the group consisting of:

non-ionic surfactants including one or more of polyoxyethylene β-naphthol ether, polyoxyethylene alkyl ether, polyoxyethylene phenylether, polyoxyethylene alkylamino ether, or polyethylene glycol;

cationic surfactants including one or more of dodecyltrimethyl ammonium salt, hexadecyltrimethyl ammonium salt, octadecyltrimethyl ammonium salt, dodecyldimethyl ammonium salt, cetyltrimethyl ammonium salt, dodecyldimethyl ammonium betaine, octadecyldimethyl ammonium betaine, dimethylbenzyldodecyl ammonium salt, trimethylbenzyl ammonium salt, octacecylamino acetate, or dodecilamino acetate;

anionic surfactants including one or more of alkyl sulphates, sodium dodecyl sulphate, lauryl sulphate, lauryl sulphonate, dodecyl sulphate, octadecyl sulphate, polyoxyethylene alkylether sulphates, sodium polyoxyethylene (EO12) nonyl ether sulphate, polyoxyethylene alkylphenylether sulphates, or alkylbenzenesulphonates; and amphoteric surfactants including one or more of betaine or sulphobetaine.

14. The electrolytic bath according to claim 12, wherein said depolarizing agents are present in a total amount comprised between 0.1 and 20 g/L, and are selected from the group consisting of: salts of alkali tartrates and alkali sulphites.

15. The electrolytic bath according to claim 12, wherein said rinse-aid/brightness giving agents are present in a total amount comprised between 0.010 and 5 mL/L, and are selected from the group consisting of: butyndiol derivatives, di-thiocarboxylic acids, rhodium salts, silver salts, and saccharinates.

16. The electrolytic bath according to claim 12, wherein said other metals are present in an amount not higher than 5%, with reference to a total amount of salts in the electrolytic bath, and are selected from the group consisting of: Zn, Rh, Pd, Au, Ga, Bi, Ag, Ta, In, and Fe.

* * * * *